US006741715B2

(12) United States Patent
Andersen

(10) Patent No.: US 6,741,715 B2
(45) Date of Patent: May 25, 2004

(54) DIGITAL HEARING AID WITH A VOLTAGE CONVERTER FOR SUPPLYING A REDUCED OPERATION VOLTAGE

(75) Inventor: Henning Haugard Andersen, Birkerod (DK)

(73) Assignee: Widex A/S, Vaerloese (DK)

( * ) Notice: Subject to any disclaimer, the term of this patent is extended or adjusted under 35 U.S.C. 154(b) by 33 days.

(21) Appl. No.: 10/188,921

(22) Filed: Jul. 5, 2002

(65) Prior Publication Data

US 2002/0196957 A1 Dec. 26, 2002

Related U.S. Application Data

(63) Continuation-in-part of application No. PCT/DK01/00007, filed on Jan. 5, 2001, now abandoned.

(30) Foreign Application Priority Data

Jan. 7, 2000 (DK) ..... 2000 00017

(51) Int. Cl.[7] ..... H04R 25/00
(52) U.S. Cl. ..... 381/323; 381/312
(58) Field of Search ..... 381/312, 314, 381/323, 120, 104, 107, 320, 321, 106; 363/60, 62; 330/297

(56) References Cited

U.S. PATENT DOCUMENTS

| | | | | |
|---|---|---|---|---|
| 4,205,369 A | | 5/1980 | Asano | |
| 4,428,040 A | * | 1/1984 | Yamashiro et al. | 363/62 |
| 5,131,046 A | * | 7/1992 | Killion et al. | 381/321 |
| 5,892,670 A | | 4/1999 | Lacey et al. | |

FOREIGN PATENT DOCUMENTS

| | | |
|---|---|---|
| GB | 2 086 156 A | 5/1982 |
| JP | 58-10969 A | 1/1983 |
| WO | WO 91/08654 A1 | 6/1991 |

* cited by examiner

*Primary Examiner*—Huyen Le
(74) *Attorney, Agent, or Firm*—Sughrue Mion, PLLC

(57) ABSTRACT

A digital hearing aid comprises a microphone (2), an output transducer (3), a digital signal processor (5) interconnected between the microphone and the output transducer, and a power source (7) including a standard hearing aid battery for the supply of operation voltage for the digital signal processor. At least one of the integrated circuit signal processing parts is designed to operate at a reduced unstabilized operation voltage substantially below a nominal voltage of the battery. A switched step-down voltage converter is connected between the power source and such signal processing parts for lowering the battery voltage to provide the reduced operation voltage.

14 Claims, 2 Drawing Sheets

DIGITAL HEARING AID WITH A VOLTAGE CONVERTER FOR SUPPLYING A REDUCED OPERATION VOLTAGE

RELATED APPLICATIONS

The present application is a continuation-in-part of application No. PCT/DK01/00007, filed on Jan. 5, 2001 in Denmark, now abandoned. The present application is based on PA 2000 00017, filed on Jan. 7, 2000 in Denmark, the contents of which are incorporated hereinto by reference.

BACKGROUND OF THE INVENTION

1. Field of the Invention

The present invention generally relates to hearing aids, and more specifically to a hearing aid comprising a digital signal processor and a standard hearing aid battery for the supply of power to the digital signal processor.

2. The Prior Art

WO-A-91/08654 describes a hearing aid comprising a microphone, an output transducer, a digital signal processor interconnected between the microphone and the output transducer, and a power source including a standard hearing aid battery for the supply of operation voltage for said digital signal processor.

In its fresh condition a normal hearing aid battery supplies a voltage of about 1.3 V. During its active life the battery can supply current sufficient for the operation of the hearing aid while the voltage gradually declines down to a voltage of about 1 V. From this instant onwards the power supplying capacity of the battery drops rapidly.

In prior art hearing aid technology it is well known, e.g. from EP-A-0 335 542, U.S. Pat. No. 4,539,440 and U.S. Pat. No. 5,581,455 to provide operation voltages higher than the nominal battery voltage for certain processing circuits or components, e.g. EEPROM memories and microphone circuits, by means of voltage step-up converters, mostly in the form of switched capacitor networks designed e.g. as so-called charge pump voltage multipliers.

Further examples of use of voltage regulators in hearing aids have been disclosed e.g. in DE-A-27 38 339, DE-C-31 34 888, DE-A-197 02 151 and WO-A-96/03848. Thus, DE-A-197 02 151 discloses a hearing aid comprising a voltage regulator capable of providing a number of stabilized supply voltages that may be higher or lower than the nominal battery voltage.

Outside the hearing aid field a voltage dropping circuit in MOSFET technology with reduced power consumption has been disclosed in U.S. Pat. No. 4,205,369.

Whereas in conventional hearing aid technology the major power supply requirement has been to provide stabilized operation voltages sufficiently high for the operation of signal processing circuits, while the provision of voltages below the nominal battery voltage has only been resorted to for voltage stabilization or provision of reference voltages, further lowering of the operation voltage has been considered inconvenient, since it would result in loss of processing speed. In certain parts of digital hearing aids such as a D/D output converter, which are responsible for a main part of the power consumption, adaptation for operating at lower voltages would only result in a current increase and would achieve no saving in power consumption for the same output power from the D/D converter.

Moreover, in small size hearing aids with a low voltage drop and a current drain of a few mA or even a fraction of mA only, the potential power saving by reduction of the operation voltage has been considered outside interest due to the complex circuitry required to implement a low loss, stabilized voltage regulator, e.g. a stabilized series voltage regulator.

The invention is based on the recognition of the fact that, as long as the operation voltage is kept above a defined minimum voltage, some integrated circuit signal processing parts of a digital hearing aid, like e.g. digital filters, are less sensitive to variations in the operation voltage in the sense that such variations would not result in any significant change of performance.

It is therefore the object of the invention to provide a digital hearing aid having a longer active battery life and a reduced power consumption.

SUMMARY OF THE INVENTION

The invention, in a first aspect, provides a hearing aid comprising a microphone, an output transducer, a digital signal processor interconnected between the microphone and the output transducer, a power source and a power voltage regulator, wherein said digital signal processor comprises a first integrated circuit signal processing part and a second integrated circuit signal processing part, wherein said first signal processing part is adapted for operating at a power supply voltage varying within a range above a predefined minimum voltage without significant change of performance, and wherein said power voltage regulator comprises a switched step-down voltage converter connected between said power source and said first signal processing part and adapted for providing a power supply voltage varying above said predefined minimum voltage.

The invention, in a second aspect, provides a hearing aid comprising a microphone, an output transducer, a digital signal processor interconnected between the microphone and the output transducer and a hearing aid battery for the supply of operation volt-age for said digital signal processor, wherein said digital signal processor comprises a first integrated circuit signal processing part and a second integrated circuit signal processing part, wherein said first signal processing part is adapted for operating at a power supply voltage varying within a range below a nominal voltage of said battery without significant change of performance, and wherein said power voltage regulator comprises a switched step-down voltage converter connected between said battery and said first signal processing part and adapted for providing a power supply voltage varying below said nominal voltage of said battery.

The invention, in a third aspect, provides a digital hearing aid comprising a microphone, an output transducer, a digital signal processor interconnected between the microphone and the output transducer and including one or more integrated circuit signal processing parts, and a power source including a standard hearing aid battery for the supply of operation voltage for each of said signal processing parts, wherein at least one of said integrated circuit signal processing parts is designed to operate at a reduced operation voltage substantially below a nominal voltage of said battery and wherein a switched step-down voltage converter is connected between the power source and said at least one signal processing part for lowering the battery voltage to provide said reduced operation voltage.

By lowering of the operation voltage requirement for parts of the integrated signal processing circuits the total current drain and power consumption of the hearing aid is reduced. In particular, this brings substantial benefits in terms of power consumption in hearing aids, where the digital signal processing is operated by large hardware programmed programs, generally likely to otherwise be associated with significant power consumption.

Preferably, the digital signal processing parts required to operate at reduced and varying operation voltages will be implemented in MOS or CMOS technology using transistors having a low operating voltage, e.g. a low threshold or pinch-off voltage, rather than bipolar processing circuits as normally used in hearing aids. Typically, such signal processing parts will comprise circuits that are not stressed with respect to processing speed or output power demand, such as digital filter circuits, whereas more stressed circuits such as an output D/D converter or output amplifier may still be supplied with a higher operation voltage.

By suitable design of such signal processing blocks, which are stressed in processing speed, involving e.g. a split-up in more parallel or serial processing blocks, the requirements to processing speed and consequently the operation voltage requirement may be lowered even for such circuit blocks.

Thus, in a preferred embodiment of the hearing aid according to the invention said first signal processing part comprises parallel signal processing blocks each operating at said varying power supply voltage. The reduced operation voltage for the signal processing parts in question would preferably be equal to or below 0.8 V, e.g. in a voltage range of half the nominal battery voltage, such as 0.7 down to 0.4 V, or preferably 0.65 down to 0.5 V.

In a preferred embodiment the switched step-down voltage converter providing the reduced operation voltage or voltages would be a capacitive charge pump converter, which may advantageously be designed to deliver two or more output voltages. However, alternatively also a switched inductor type converter could be envisaged.

BRIEF DESCRIPTION OF THE DRAWINGS

In the following the invention will be explained in further detail with reference to the accompanying drawings, of which

DESCRIPTION OF THE PREFERRED EMBODIMENTS

Figure 1:
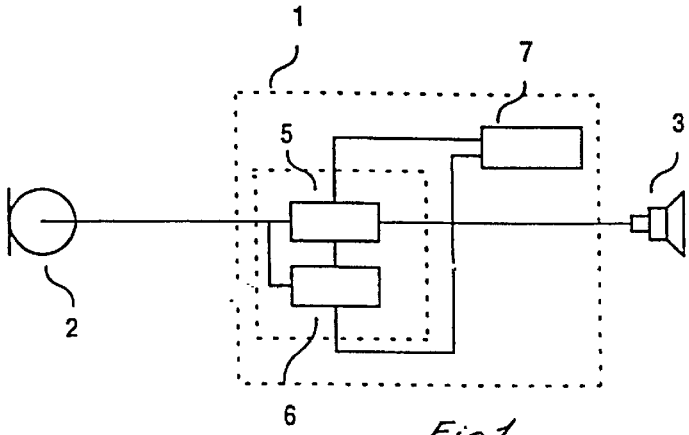
FIG. 1 is a schematical block diagram of an embodiment of a digital hearing according to the invention.

The hearing aid schematically illustrated in FIG. 1 comprises electric circuits 1 interconnected between a microphone 2 and an output transducer or receiver 3. The electric circuits 1 include a signal processing part 5, a control part 6 and a power supply part 7. In a digital hearing aid the signal processing parts 5 will comprise at least an A/D converter for conversion of the analog signal from the microphone 2 into digital form, a digital signal processing circuit including filters and amplifiers and an output converter supplying to the output transducer 3 a digital or analog output signal, suitable for compensating for the users hearing impairment.

Figure 2:
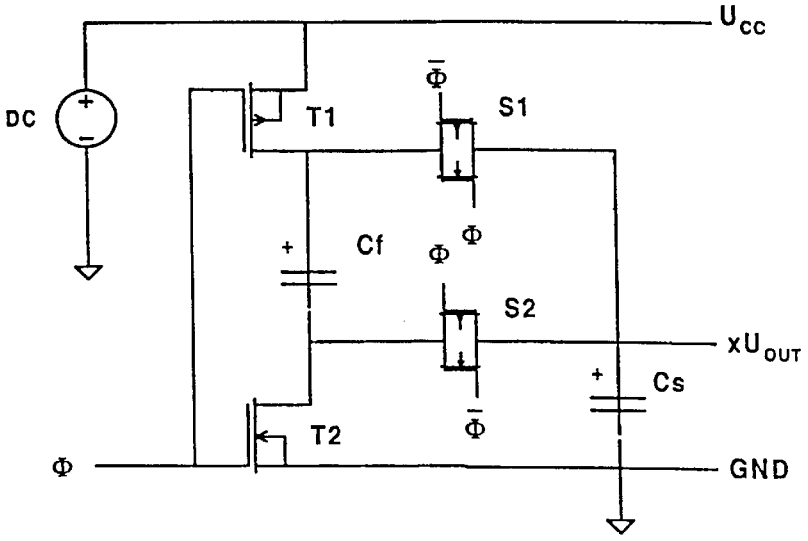
FIG. 2 shows a first configuration of a switched capacitor voltage step-down converter of the charge pump type for use in the hearing aid shown in FIG. 1, FIGS. 3 and 4 are simplified diagrams illustrating charge situations in the converter configuration in FIG. 2.

The switched capacitor voltage step down converter of the charge pump type illustrated in FIG. 2 is of a type generally known from U.S. Pat. No. 4,205,369 and comprises in series connection with a voltage source DC such as a hearing aid battery supplying a nominal voltage $U_{cc}$ of about 1.3 V, a converter configuration supplying an output voltage $xU_{out}$ which is about half the nominal battery voltage. The converter circuit comprises a pair of transistors T1 and T2 shown as p- and n-type MOSFET transistors, respectively, which are controlled by a control voltage v and connected with switch circuits S1 and S2, respectively, which may each be implemented as a pair of n- and p-type MOSFET transistors, respectively, controlled by opposite clock phases.

Transistors T1 and T2 and switch circuits S1 and S2 control charging and discharging of two capacitors $C_f$ and $C_s$ as follows.

Figure 3:
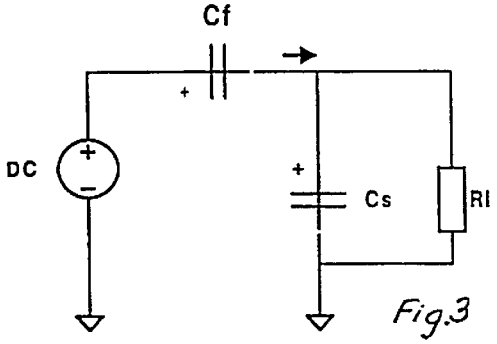

When the control voltage v is non-active or "low", transistor T1 is on and transistor T2 off and switch circuit S1 is inactive and switch circuit S2 active, so that capacitors $C_f$ and $C_s$ are charged in series as shown in the equivalent diagram in FIG. 3.

Figure 4:
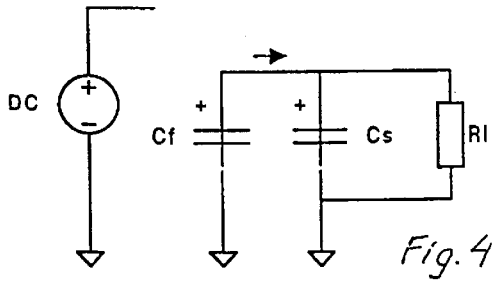

When the control voltage v is active or "high", transistor T1 is off and transistor T2 on and switch circuits S1 is active and switch circuit S2 inactive, so that capacitors $C_f$ and $C_s$ are discharged in parallel to the load as shown in the equivalent diagram in FIG. 4. In the diagrams in FIGS. 3 and 4 a load is represented by a resistor R1.

If capacitors $C_f$ and $C_s$ are of equal capacitance, the battery voltage $U_{cc}$ is divided into a half and the reduced supply voltage $xU_{out}$ will be about the half of the battery voltage.

Figure 5:
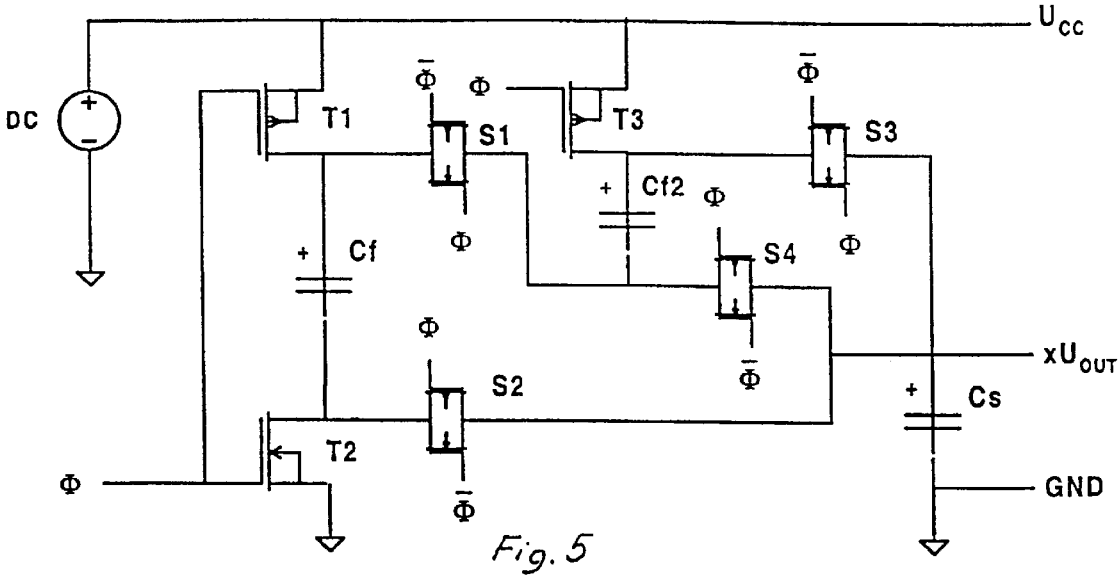
FIG. 5 shows a second configuration of a switched capacitor voltage step-down converter of the charge pump type for use in the hearing aid shown in FIG. 1, and FIGS. 6 and 7 are simplified diagrams illustrating charge situations in the converter configuration in FIG. 2.

In the configuration shown in FIG. 5 three MOSFET transistors T1, T2 and T3 and four switch circuits S1, S2, S3 and S4 are connected to control the charging and discharging of three capacitors $C_f$, $C_{f2}$ and $C_s$ in the same way as described above.

Figure 6:
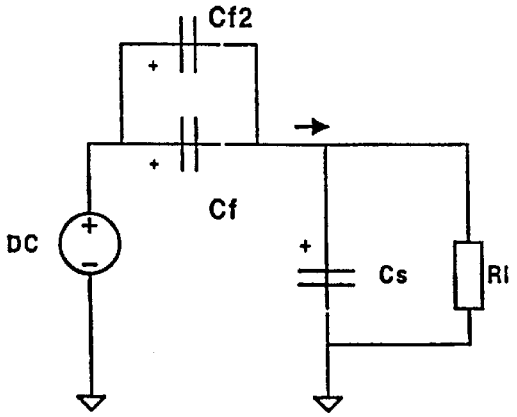

When the control voltage v is "low" transistors T1 and T3 are on and transistor T2 off, while switch circuits S2 and S4 are active and switch circuits S1 and S3 inactive, so that capacitor $C_s$ is charged in series with the parallel connection of capacitors $C_f$ and $C_{f2}$ as shown in the equivalent diagram in FIG. 6.

Figure 7:
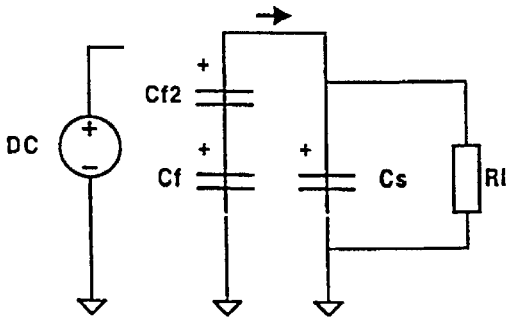

When the control voltage v is "high" transistors T1 and T3 are off and transistor T2 on, while switch circuits S2 and S4 are inactive and switch circuits S1 and S3 active, so that the series connection of capacitors $C_f$ and $C_{f2}$ is discharged in parallel to the capacitor $C_s$ and the resistor R1 in parallel therewith as shown in the equivalent diagram in FIG. 7.

If capacitors $C_f$, $C_{f2}$ and $C_s$ are of equal capacitance the battery voltage $U_{cc}$ is divided into thirds and the reduced supply voltage $xU_{out}$ will be about the two thirds of the battery voltage.

The configurations shown in FIGS. 3 and 6 are only examples of preferred embodiments of switched capacitor charge pump converters for use in digital hearing aids according to the invention. Within the scope of the invention one or more reduced operation voltages for different signal processing parts of the hearing aid can be obtained as fractions of the battery voltage.

As will follow from the description above the reduced operation voltage supplied by the voltage step-down converter of the invention will initially not be stabilized and will thus follow fluctuations of the battery voltage. It would obvious for an expert, however, to generate also a stabilized lower voltage, when needed, by means of a conventional stabilizing voltage regulator, while maintaining the benefit of a lower power consumption resulting from the invention.

I claim:

1. A hearing aid comprising a microphone, an output transducer, a digital signal processor interconnected between the microphone and the output transducer, and a power source, wherein said digital signal processor comprises an integrated circuit signal processing part adapted for operating without significant change of performance at a power supply voltage fluctuating within a range above a predefined minimum voltage, and wherein said power source comprises a switched step-down voltage converter adapted for providing to said signal processing part a power supply voltage fluctuating above said predefined minimum voltage.

2. The hearing aid as claimed in claim 1, wherein said signal processing part is implemented in CMOS technology.

3. The hearing aid as claimed in claim 1, wherein said signal processing part comprises parallel signal processing blocks, each operating at said varying power supply voltage.

4. The hearing aid as claimed in claim 1, wherein said signal processing part is adapted for operating at a power supply voltage equal to or lower than 0.8 volts.

5. The hearing aid as claimed in claim 1, wherein said converter comprises a capacitive charge pump converter.

6. The hearing aid as claimed in claim 5, wherein said charge pump converter is designed to deliver at least two output voltages.

7. The hearing aid as claimed in claim 1, wherein said voltage converter comprises a switched inductor network converter.

8. A hearing aid comprising a microphone, an output transducer, a digital signal processor interconnected between the microphone and the output transducer and a power source for the supply of operation voltage for said digital signal processor, wherein said digital signal processor comprises an integrated circuit signal processing part, wherein said power source comprises a battery and a switched step-down voltage converter connected between said battery and said signal processing part, wherein said converter is adapted for providing a power supply voltage fluctuating below a nominal voltage of said battery, and wherein said signal processing part is adapted for operating without significant change of performance at a power supply voltage fluctuating with a range below a nominal voltage of said battery.

9. The hearing aid as claimed in claim 8, wherein said signal processing part is adapted for operating at a power supply voltage equal to or lower than 0.8 volts.

10. A digital hearing aid comprising a microphone, an output transducer, a digital signal processor interconnected between the microphone and the output transducer and including at least one integrated circuit signal processing part, and a power source, wherein said power source includes a standard hearing aid battery and a switched step-down voltage converter for the supply of a power supply voltage to said signal processing part, wherein said voltage converter is connected between said battery and said at least one signal processing part and adapted for providing a power supply voltage reduced to a fraction of the battery voltage, and wherein said integrated circuit signal processing part is designed to operate at a reduced power supply voltage substantially below a nominal voltage of said battery.

11. The hearing aid according to claim 10, wherein said converter is adapted for lowering the power supply voltage to two thirds of the battery volt-age.

12. The hearing aid according to claim 10, wherein said converter is adapted for lowering the power supply voltage to half of the battery voltage.

13. The hearing aid according to claim 10, wherein said converter is adapted for lowering the power supply voltage to within the range from 0.7 V to 0.4 V.

14. The hearing aid according to claim 10, wherein said converter is adapted for lowering the power supply voltage to within the range from 0.65 V to 0.5 V.

* * * * *